US007353641B2

(12) United States Patent
Yoshii et al.

(10) Patent No.: US 7,353,641 B2
(45) Date of Patent: Apr. 8, 2008

(54) VOID FORMING CORE FORMWORK FOR CONCRETE BEAM

(75) Inventors: Hisafumi Yoshii, Kasugai (JP); Yoshinori Hikasa, Kurashiki (JP)

(73) Assignees: Ecoboard Co., Ltd., Okayama (JP); P.S Mitsubishi Construction Co., Ltd., Tokyo (JP)

( * ) Notice: Subject to any disclaimer, the term of this patent is extended or adjusted under 35 U.S.C. 154(b) by 284 days.

(21) Appl. No.: 11/069,556

(22) Filed: Mar. 2, 2005

(65) Prior Publication Data

US 2005/0229536 A1 Oct. 20, 2005

(30) Foreign Application Priority Data

Mar. 3, 2004 (JP) ..... 2004-059105

(51) Int. Cl.
*B28B 7/28* (2006.01)

(52) U.S. Cl. ..... 52/577; 249/DIG. 2

(58) Field of Classification Search ..... 52/576, 52/577; 229/939, 23 AB; 428/184, 186, 428/116, 119, 120; 493/90, 162, 906; 249/61, 249/175, 184, 185, DIG. 2; 264/271.1, 279.1
See application file for complete search history.

(56) References Cited

U.S. PATENT DOCUMENTS 941,256 A * 11/1909 Jenkins ..... 229/939
1,543,205 A * 6/1925 Crowell ..... 229/939
1,953,410 A * 4/1934 Jacobson ..... 52/576
2,477,852 A * 8/1949 Bacon ..... 428/116
2,501,180 A * 3/1950 Kunz ..... 428/116
2,985,553 A * 5/1961 Anderson ..... 428/186
3,024,513 A * 3/1962 Shuxteau et al. ..... 249/134
3,293,107 A * 12/1966 Wells et al. ..... 428/186
3,518,142 A * 6/1970 Dooley ..... 428/182
3,549,116 A * 12/1970 Ferry et al. ..... 249/184
3,559,867 A * 2/1971 Muskopf et al. ..... 229/939
3,859,125 A * 1/1975 Miller et al. ..... 428/116
3,913,822 A * 10/1975 Heaps, Jr. ..... 229/939
4,188,761 A * 2/1980 McKay ..... 428/119
4,647,063 A * 3/1987 Piringer et al. ..... 428/186
4,685,267 A * 8/1987 Workman ..... 52/577
5,040,696 A * 8/1991 Liebel ..... 229/122.32
5,102,272 A * 4/1992 Woods et al. ..... 410/154
5,492,267 A * 2/1996 Hollander et al. ..... 428/116

(Continued)

FOREIGN PATENT DOCUMENTS

FR 2198042 A 3/1974

(Continued)

*Primary Examiner*—M. Safavi
(74) *Attorney, Agent, or Firm*—Sughrue Mion, PLLC

(57) ABSTRACT

To render a formwork (10), having a hollow (11*b*) defined therein and embedded in the elongated concrete member (40) during casting of a concrete material, to be lightweight, environmentally friendly and inexpensive and to have a sufficient strength, the formwork (10) includes a tubular member (11) formed by bending an oblong plate of corrugated cardboard (5) made of paper. The corrugated cardboard plate (5) includes a plurality of corrugated cardboards (3) laminated together and each formed by bonding liner sheets (2) to surfaces of a corrugated sheet (1). The corrugated cardboards (3) are laminated together with flutes of the corrugated cardboards (3) oriented in a direction (P) across a thickness of the corrugated cardboard plate (5), and a sheet (4) is bonded to front and rear major surfaces thereof.

6 Claims, 10 Drawing Sheets

U.S. PATENT DOCUMENTS 5,782,049 A * 7/1998 Gates et al. ..... 52/577
6,007,470 A * 12/1999 Komarek et al. ..... 493/397
6,029,884 A * 2/2000 Roeland ..... 229/939
6,050,043 A * 4/2000 Rosenblat et al. ..... 52/577
6,722,560 B2 * 4/2004 Player et al. ..... 229/939
6,794,017 B2 * 9/2004 Comeau et al. ..... 428/182

FOREIGN PATENT DOCUMENTS

JP 59229341 A 12/1984
JP 60-002897 1/1985
JP 2001161458 A 6/2001

* cited by examiner

VOID FORMING CORE FORMWORK FOR CONCRETE BEAM

BACKGROUND OF THE INVENTION

1. Field of the Invention

The present invention relates to a hollow formwork for use in making a concrete elongated member used to form a concrete roadbed of, for example, a high level roadway or a road bridge. Specifically, the concrete beam herein referred to may be such as used as a prestressed concrete bridge beam of a kind stipulated in JIS-A-5373 as a precast prestressed concrete product.

2. Description of the Prior Art

A concrete roadbed 100, shown in FIG. 12, of a high level roadway or a road bridge which is an example of the concrete product and is formed by a road subgrade 102 made up of a plurality of concrete beams 112 juxtaposed with each other in a direction widthwise of the roadway and laid above spaced piers 101. To complete the high level roadway or road bridge, concrete mortar is cast on an upper surface of the concrete roadbed 100. The concrete beams 112 are in the form of an elongated hollow concrete bar having an axially extending hollow 112*a*, as shown in FIG. 13, for the purpose of reducing the weight and increasing the strength. The hollow 112*a* in each of the concrete beams 112 is required to have a generally heptagonal shape according to JIS-A-5373 and, accordingly, in order to define this hollow 112*a* in each concrete beam 112, an inner hollow formwork 113 is embedded in the respective concrete beam 112.

As a material for the inner hollow formwork 113, a lightweight synthetic resinous foam material has hitherto been used. See, for example, the Japanese Laid-open Patent Publication No. 7-331614. It is, however, been found that where the roadbed 100 is formed with the concrete beams 112 each having embedded therein an inner hollow formwork 113 made of foamed styrene, a substantial amount of obnoxious or harmful industrial wastes would result in when the concrete roadbed is wrecked or dismounted in the future.

In view of the above, as a material for the hollow inner formwork 113, environmentally friendly wooden boards are employed. Also, for further reduction in weight, the use of hollow inner formworks has come to be contemplated, which is made of corrugated cardboard formed by bonding liners to opposite surfaces of a corrugated fiberboard. See, for example, the Japanese Utility Model Publication No. 60-2897.

Where the hollow inner formworks made of the corrugated cardboard are used in forming the concrete beams 112, each hollow inner formwork 113A is, as shown in FIG. 14, placed inside an elongated outer mold 114 and, then, ready-mix concrete is poured into the elongated outer mold 114 so as to encompass the hollow inner formwork 113A. However, it has been found that, during the concrete casting, portions of the corrugated cardboard 120 forming the hollow inner formwork 113A tend to be collapsed as shown in FIG. 15 under the influence of a compressive force brought about by the ready-mix concrete being externally poured. Once the hollow inner formwork 113A deforms as a result of the collapse of the corrugated cardboard 120, the amount of concrete 108 cast at collapsed portions 120 of the corrugated cardboard 120 will increase with the balance of the strength of the respective concrete beam 112 ruined consequently, resulting in reduction of the overall strength of the concrete beam 112. Accordingly, the hollow inner formwork 113A made of corrugated cardboard, which is actually used, is reinforced with a reinforcement material such as, for example, wooden board. The additional use of the wooden board to reinforce the hollow inner formwork 113A made of corrugated cardboard results in increase of the weight and, hence, increase of the cost as compared with the sole use of the corrugated cardboard.

SUMMARY OF THE INVENTION

In view of the foregoing, the present invention is intended to provide an environmentally friendly, inexpensive hollow inner formwork made of corrugated cardboard, which is lightweight and has a sufficient strength and which can be used in an elongated concrete member such as, for example, a concrete beam used to form a concrete roadbed of, for example, a high level roadway or a road bridge.

In order to accomplish the foregoing object, the hollow formwork for an elongated concrete member herein provided in accordance with the present invention is of a kind adapted to be embedded in the elongated concrete member during casting of a concrete material to define a hollow in the elongated concrete member. This hollow formwork of the present invention includes a tubular member having a polygonal section formed by bending an oblong plate of corrugated cardboard made of paper. The corrugated cardboard plate includes a plurality of corrugated cardboards laminated together and each formed by bonding liner sheets to surfaces of a corrugated sheet. The corrugated cardboards have flutes oriented in a direction across a thickness of the corrugated cardboard plate, and a sheet bonded to front and rear major surfaces thereof.

It is generally well known that the corrugated cardboard 3 made up of a corrugated sheet 1 and liner sheets 2 bonded to opposite surfaces of the corrugated sheet 1, respectively, is prominently susceptible to deformation when a compressive force is applied thereto in a direction C perpendicular to a major surface of the liner sheet 2, and susceptible to deformation when a compressive force is applied thereto in a direction B parallel to the major plane of the liner sheet 2 and perpendicular to ridges 1*a* of the corrugated sheet 1, but can resist to the compressive force applied in a direction B parallel to the ridges 1 or flutes in the corrugated cardboard.

Accordingly, since the formwork according to the present invention includes the tubular member prepared from the corrugated cardboard plate formed by bonding a plurality of corrugated cardboards together and since the flutes of the corrugated cardboards are oriented in a direction across the thickness of the corrugated cardboard plate, the direction of the flutes of the corrugated cardboard having a high strength confront the direction in which the compressive force acts from the surrounding concrete, to thereby avoid an undesirable deformation of the tubular member. Hence, the formwork having a high strength can be obtained. The use of this formwork can contribute to avoid reduction in strength of the elongated concrete member as a whole. Also, since the corrugated cardboard plate is made of paper, the formwork which is lightweight, environmentally friendly and inexpensive can be obtained.

In a preferred embodiment of the present invention, portions of the corrugated cardboard plate, which are bent to form the tubular member, may be formed with respective cutouts each having a generally V-shaped section before the corrugated cardboard plate is bent to provide the tubular member. Specifically, the corrugated cardboard plate used as a material for the tubular member of the formwork according to the present invention has such high a strength in a direction across the thickness thereof that it cannot be easily bent. Accordingly, formation of the cutouts of the generally V-shaped section at the respective portions of the corrugated cardboard plate effectively facilitate bending of the corrugated cardboard plate and, accordingly, the formwork having a desired sectional shape can easily be obtained.

In another preferred embodiment of the present invention, a plurality of partition walls made of a corrugated cardboard may be utilized and positioned inside the tubular member for dividing a hollow of the tubular member into cells. In this case, each of the partition walls is made up of a plurality of corrugated cardboards bonded together with flutes thereof oriented in a direction parallel to a major surface of the respective partition wall, each of which corrugated cardboards is formed by bonding liner sheets to surfaces of a corrugated sheet, Also, at least one of the corrugated cardboards forming the respective partition wall has the flutes oriented in a direction perpendicular to those of the other of the corrugated cardboards.

The use of the partition walls is effective to reinforce the tubular member against the compressive force applied from the surrounding concrete material during the casting of the concrete material. At this time, since the compressive force acts on the partition walls in a direction shown by A or B in FIG. 16, that is, in a direction parallel to the liner sheets 2, the strength of the partition walls is high. Also, since at least one of the corrugated cardboards forming the respective partition wall has the flutes oriented in a direction perpendicular to those of the other of the corrugated cardboards, the compressive force acting on the partition walls through the tubular member acts in the direction A, which exhibits the highest possible strength, as far as at least one of the corrugated cardboards is concerned, and, therefore, the strength of the partition walls can further be increased. In addition, lamination of the plural corrugated cardboards can result in increase of the bending strength of the partition walls.

In a still further preferred embodiment of the present invention, the formwork may include a plurality of tubular members connected end-to-end with each other through a connecting wall member. In this case, the connecting wall member includes a base board made of paper liners and having its opposite surface to which respective undersized engagement blocks each prepared from a corrugated cardboard plate are bonded. The undersized engagement blocks are, when the tubular members are connected with each other, received within respective open ends of those tubular members. According to this feature, since the tubular members are connected together with the undersized engagement blocks received within the respective open ends of the neighboring tubular members, no connection between the tubular members will become bulky and a relatively high connecting strength can be obtained.

In a still further preferred embodiment of the present invention, an end wall member made of paper for closing each of opposite open ends of the tubular member or a row of tubular members may be employed. This end wall member includes a body made of the corrugated cardboard plate, with the flutes of the corrugated cardboards forming the corrugated cardboard plate being oriented in a direction across a thickness of the corrugated cardboard plate. According to this feature, since the flutes of the corrugated cardboards used to form the end wall member are oriented in a direction across the thickness of the end wall member, the end wall can exhibit a high strength against the compressive force acting from the surrounding concrete to the end wall member in a direction across the thickness of such end wall member.

In a still further preferred embodiment of the present invention, the tubular member and the end wall member may have their respective outer surfaces treated with a waterproofing treatment, so that no water component will soak in the formwork during the casting of the concrete material and, therefore, an undesirable reduction in strength of the formwork, made of paper, resulting from absorption of the water component can advantageously be avoided.

BRIEF DESCRIPTION OF THE DRAWINGS

In any event, the present invention will become more clearly understood from the following description of preferred embodiments thereof, when taken in conjunction with the accompanying drawings. However, the embodiments and the drawings are given only for the purpose of illustration and explanation, and are not to be taken as limiting the scope of the present invention in any way whatsoever, which scope is to be determined by the appended claims. In the accompanying drawings, like reference numerals are used to denote like parts throughout the several views, and:

DETAILED DESCRIPTION OF THE EMBODIMENTS

Hereinafter, the present invention will be described in detail in connection with a preferred embodiment thereof with reference to the accompanying drawings.

Figure 1:
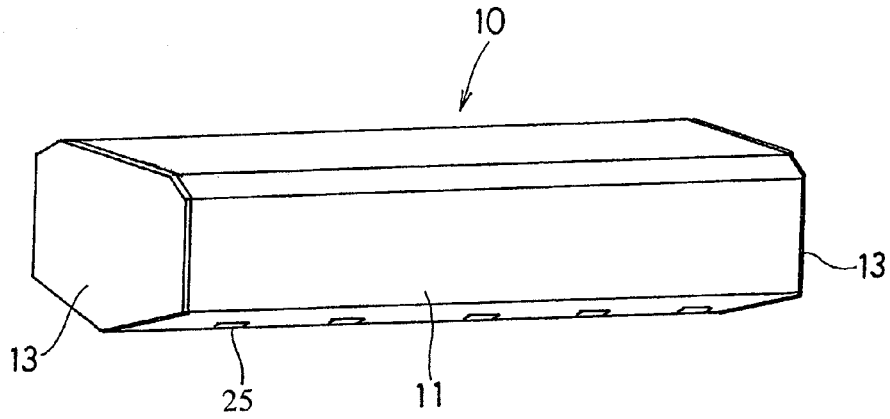
FIG. 1 is a perspective view of an elongated formwork that is embedded in an elongated concrete member according to a preferred embodiment of the present invention.
Figure 2:
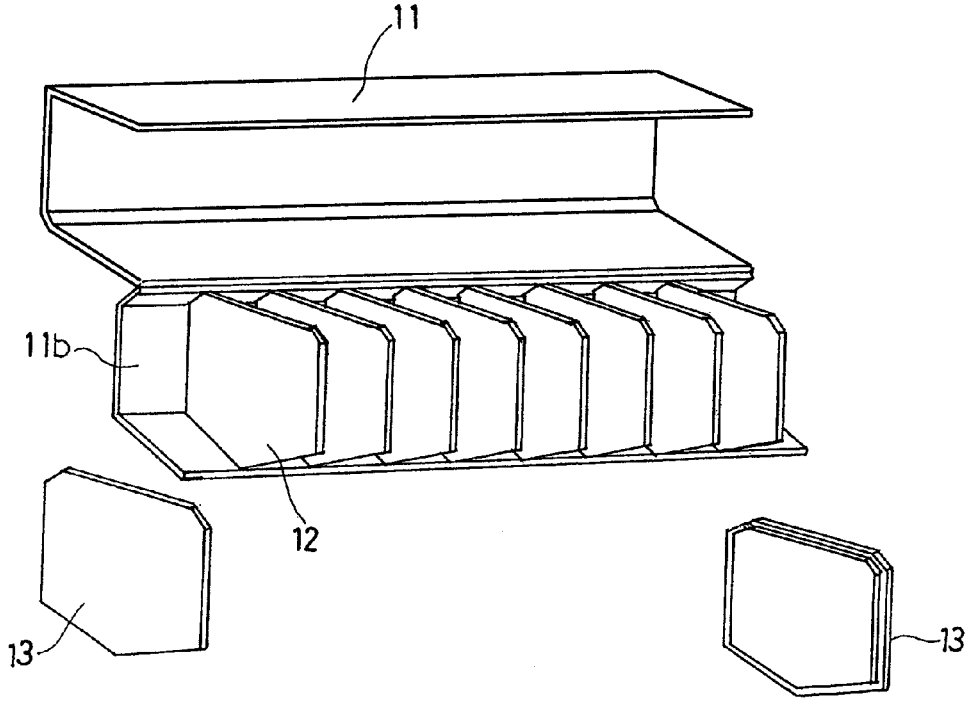
FIG. 2 is an exploded view of the elongated formwork shown in FIG. 1.
Figure 12:
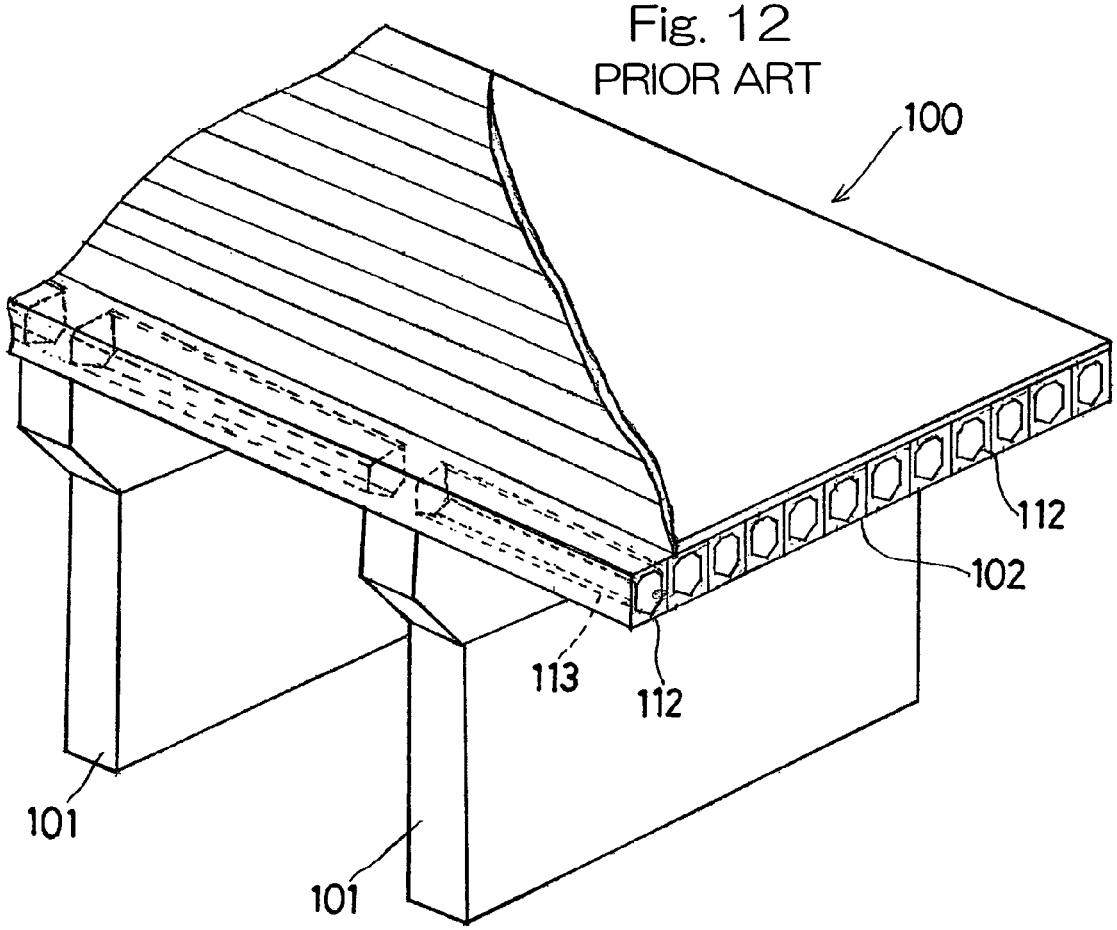
Fig. 12 PRIOR ART
FIG. 12 is a perspective view, on an enlarged scale, showing a conventional high level roadway.
Figure 13:
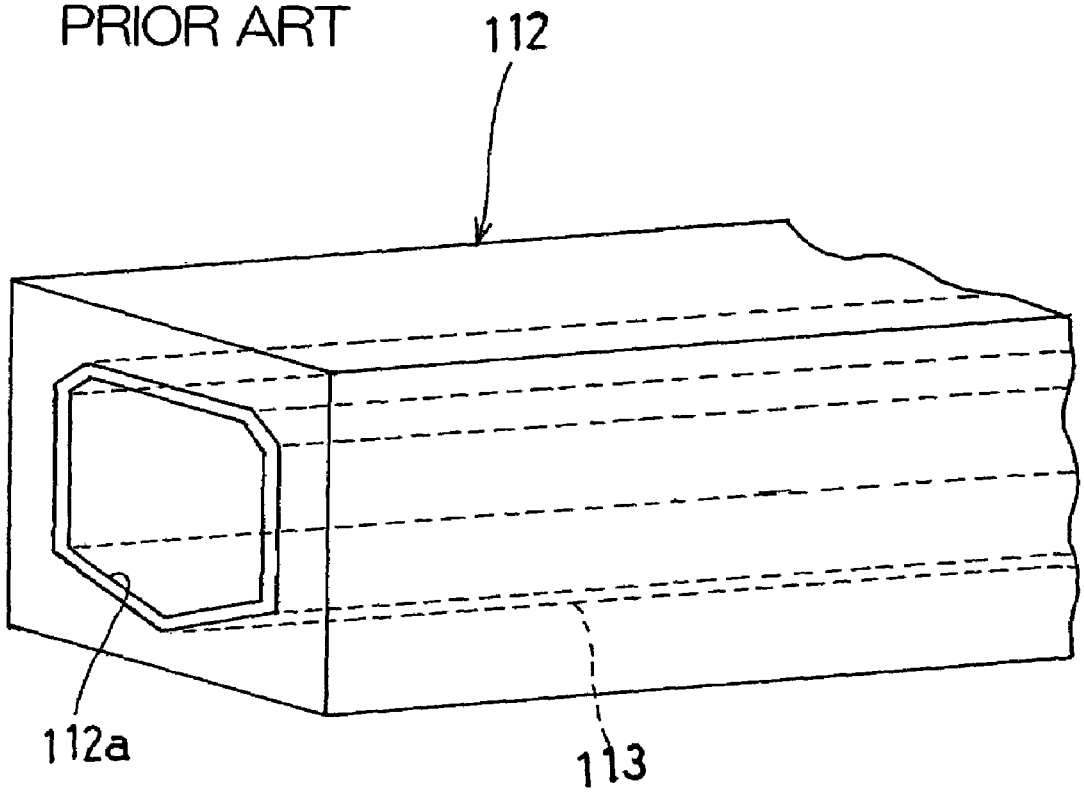
Fig. 13 PRIOR ART
FIG. 13 is a perspective view showing a portion of a concrete beam used in the high level roadway shown in FIG. 12.

FIG. 1 illustrates, in a perspective view, an elongated formwork 10 made of paper material, particularly a corrugated cardboard according to the preferred embodiment of the present invention. The elongated formwork 10 is adapted to be embedded in an elongated concrete member such as, for example, a concrete beam that forms a part of the road subgrade discussed with reference to FIG. 12, and is in the form of a pillar of a generally heptagonal section. As best shown in FIG. 2, this elongated formwork 10 includes a tubular member 11 of a generally heptagonal sectional shape formed by bending a plate of corrugated cardboard and having a hollow 11*b* defined therein, a plurality of partition walls 12 disposed inside the tubular member 11 so as to divide the hollow 11*b* into a plurality of cells, and an end wall 13 for closing an open end of the tubular member 11, respectively. An outer surface of the tubular member 11 and an outer surface of the end wall 13 are subjected to a waterproofing treatment to have a coating of a waterproofing material such as, for example, paraffin.

Figure 3:
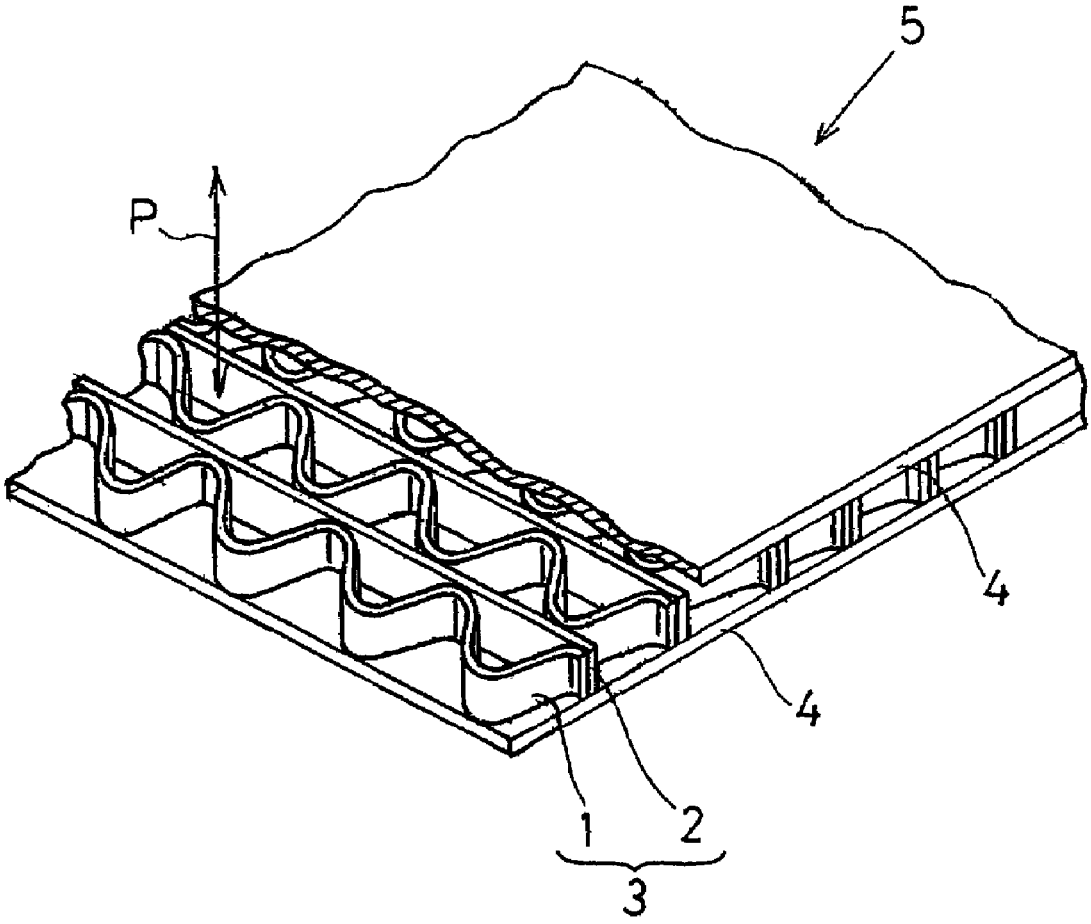
FIG. 3 is a perspective view, with a portion broken away, of a corrugated cardboard plate used to form the elongated formwork of the present invention.

The tubular member 11 is formed by bending the corrugated cardboard plate 5 as shown in FIG. 3. The corrugated cardboard plate 5 includes a plurality of corrugated cardboards 3, each made up of a corrugated sheet 1 and liner sheets 2 bonded to one surface or opposite surfaces of the corrugated sheet 1, which are laminated together, and sheets 4 and 4 bonded by the use of a bonding agent to front and rear major surfaces of the corrugated cardboards 3, which lie perpendicular to flutes of the corrugated sheets 1. This corrugated cardboard plate 5 has a thickness as measured in a direction P parallel to the flutes of the corrugated sheets 1, which thickness may be, for example, about 15 mm.

Figure 4A:
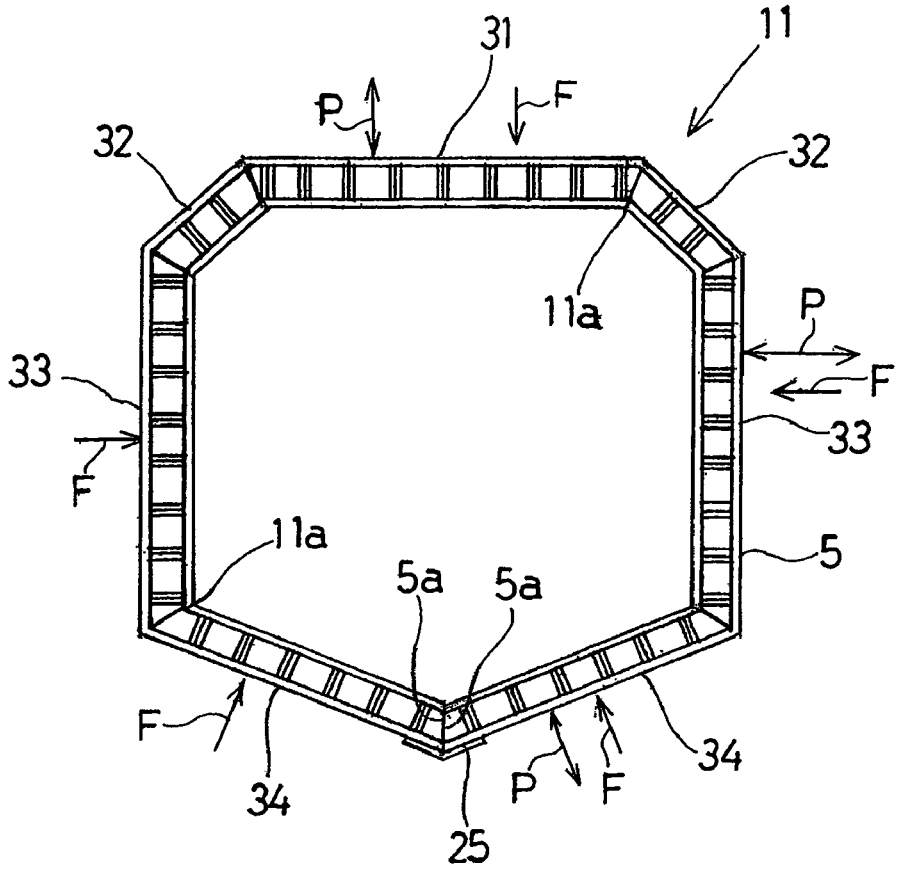
FIG. 4A is a transverse sectional view of the elongated formwork showing an elongated tubular member.

The corrugated cardboard 5 of the structure shown in and described with reference to FIG. 3 is bent to provide the tubular member 11 of the generally heptagonal sectional shape as shown in FIG. 4A. The generally heptagonal section of the tubular member 11 is defined by an horizontal upper side 31, left and right shoulder sides 32 continued from and inclined downwardly from respective opposite ends of the horizontal upper side 31, vertical sides 33 continued from the respective downwardly inclined shoulder sides 32 so as to lie perpendicular to the upper side 31, and left and right lower sides 34 continued from the respective vertical sides 33 so as to converge with each other at a point of merge which is defined by opposite end edges 5*a* of the corrugated cardboard plate 5 having been so bent. Those opposite end edges 5*a* are jointed together by means of an adhesive tape 25 such as, for example, a gummed tape, which is applied at a plurality of locations spaced in a direction lengthwise of the resultant tubular member 11. By so designing, it is possible to avoid an undesirable deformation of the tubular member 11 since the flutes of the corrugated cardboards 3, which exhibit a high strength, are oriented in a direction P parallel to the direction in which a compressive force F acts from the surrounding concrete.

Figure 4B:
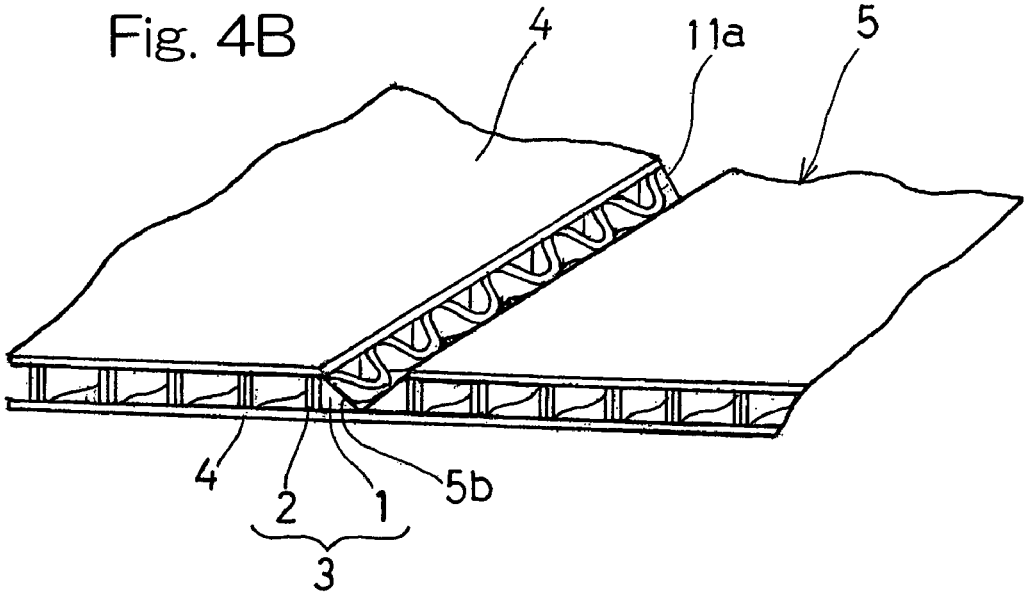
FIG. 4B is a perspective view of the corrugated cardboard plate showing a cutout formed therein.

The tubular member 11 formed by bending the corrugated cardboard plate 5 as hereinabove described has six angled corners 11*a* each defined by a substantially V-shaped cutout 5*b* formed in the corrugated cardboard plate 5 prior to the latter being bent to provide the tubular member 11 as best shown in FIG. 4B. In other words, prior to the corrugated cardboard plate 5 being bent to provide the tubular member 11, the V-shaped cutouts 5*b* are formed in one of opposite surfaces of the corrugated cardboard plate 5, which defines an inner surface of the eventually formed tubular member 11, so as to extend from the relevant sheet 4 into the corrugated sheet 3, leaving the other sheet 4. The presence of those cutouts 5*b* allow the corners 11*a* of the tubular member 11 to be substantially free from wrinkles, having been neatly bent to a stabilized shape.

Figure 5:
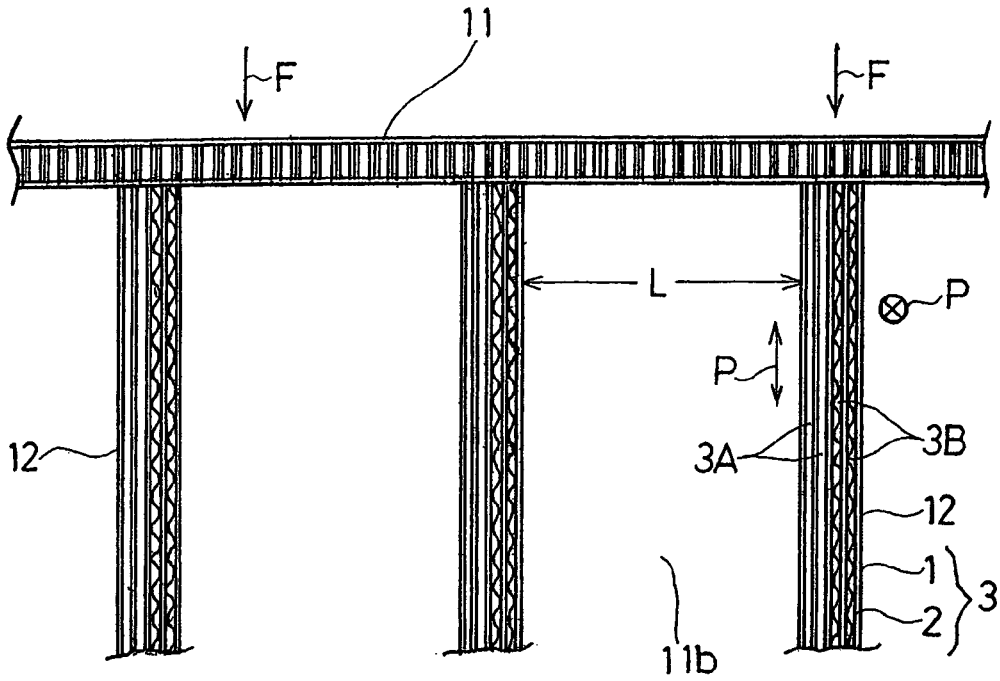
FIG. 5 is a fragmentary longitudinal sectional view, on an enlarged scale, showing the manner in which partition walls are held in position within the elongated tubular member of the formwork.
Figure 6:
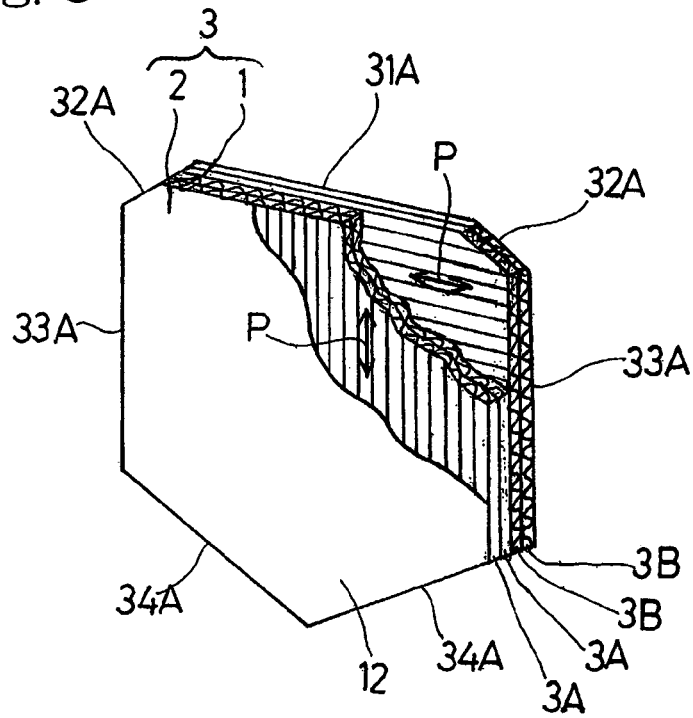
FIG. 6 is a perspective view, with a portion removed away, showing one of the partition walls used in the elongated formwork.

As shown in FIG. 5, the hollow 11*b* of the tubular member 11 is divided by the partition walls 12 disposed inside the tubular member 11 and spaced a predetermined distance L from each other in a direction lengthwise of the tubular member 11. Each of the partition walls 12 is of a shape complemental to the cross-sectional shape of the hollow 11*b* of the tubular member 11 and is bonded to the tubular member 11 by the use of an adhesive material such as, for example, glue. As best shown in FIG. 6, each of the partition walls 12 is made up of a first laminate of at least two corrugated cardboards 3A, bonded together in face-to-face relation with each other with respective flutes thereof oriented in the same direction, and a second laminate of at least two corrugated cardboards 3B similarly bonded together in face-to-face relation with each other with respective flutes thereof oriented in the same direction, which second laminate is bonded together with the first laminate in face-to-face relation with each other with the flutes in the first laminate oriented in a direction perpendicular to those in the second laminate. Each of the corrugated cardboards 3A and 3B is made up of the corrugated sheet 1 and the liner sheet 2. Each of the partition walls 12 so prepared has a thickness of about 20 mm.

The partition wall 12 has upper, shoulder, left, right, left lower and right lower sides 31A to 34A which contact the corresponding sides 31 to 34 of the tubular member 11 when the partition wall 12 is positioned inside and bonded to the tubular member 11 shown in FIG. 5. In the example shown in FIG. 6, double arrow-headed lines shown by P represent a direction of extension of the flutes of the corrugated cardboards 3A and that of the corrugated cardboards 3B, respectively, the flutes of the corrugated cardboards 3A of the first laminate are oriented in the direction P perpendicular to the horizontal upper side 31A of the partition wall 12, whereas the flutes of the corrugated cardboards 3B of the second laminate are similarly oriented in the direction P perpendicular to the vertical sides 33A of the partition wall 12.

Figure 16:
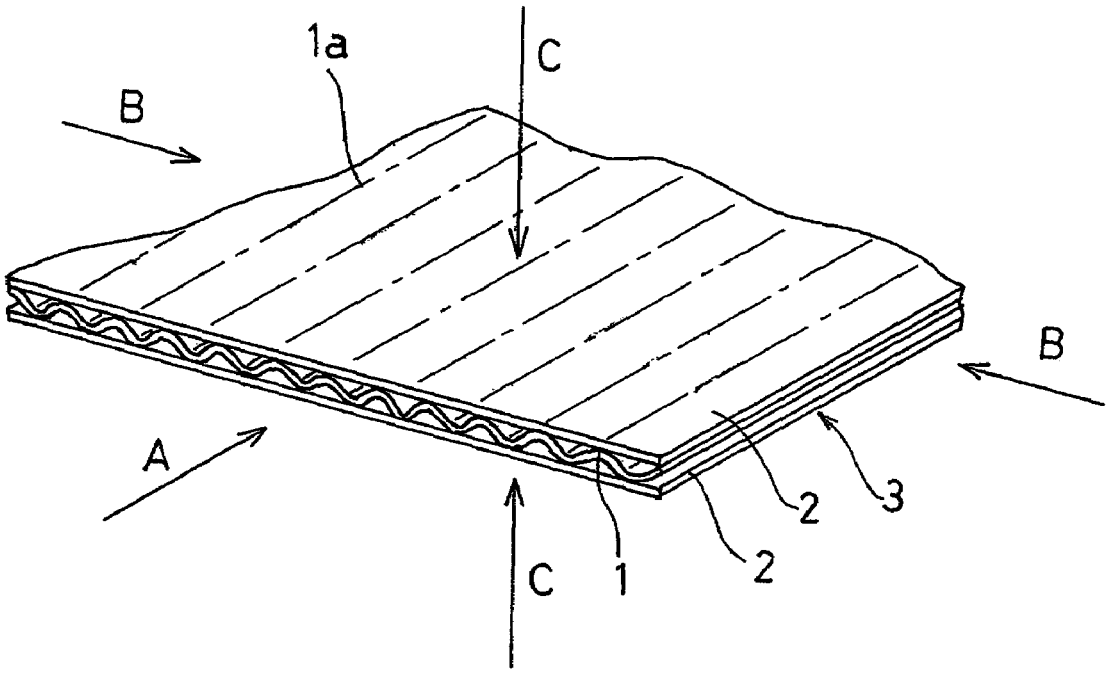
Fig. 16 PRIOR ART
FIG. 16 is a perspective view of the standard corrugated cardboard.

With the partition walls 12 positioned inside and bonded to the tubular member 11, the partition walls 12 are subjected to the compressive force F applied thereto through an outer peripheral surface of the tubular member 11 of FIG. 5 during the casting of the concrete material. However, according to the present invention, the partition walls 12 can exhibit a high compressive strength since the applied compressive force F acts in a direction parallel to the major surfaces of the liner sheets 2, which exhibit a relatively high strength (see the directions A and B shown in FIG. 16). Also, since one of the first and second laminates of the corrugated cardboards 3A and 3B has the direction P of extension of the flutes, which exhibits a high compressive strength and which is exactly aligned or substantially aligned with the direction in which the applied compressive force F acts through the respective sides 31 to 34 of the tubular member 11, they can exhibit an increased strength.

The neighboring partition walls 12 positioned inside the tubular member 11 shown in FIG. 5, are spaced a distance L, which may be twice or three times that of a partition wall made up of a single corrugated cardboard, while maintaining substantially same strength of the tubular member 11. This is because as hereinbefore described each partition wall 12 employed in the present invention is of the structure in which the first and second laminates, each made up of at least two corrugated cardboards 3A or 3B, are bonded together with the flutes in the first laminate lying in the direction different from those in the second laminate. In addition, since each partition wall 12 is made up of at least two corrugated cardboards 3A or 3B bonded together, the partition wall 12 itself exhibits a relatively high bending strength.

Figure 7:
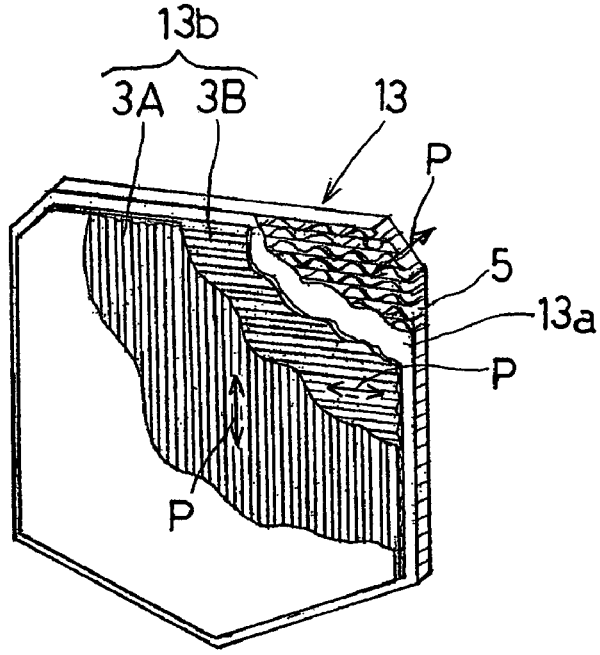
FIG. 7 is a perspective view, with a portion removed away, showing an end wall used in the elongated formwork.

Referring now to FIG. 7, the end wall 13 used to close the respective open end of the tubular member 11 includes a generally heptagonal body 13*a* made up of the corrugated cardboard plate 5 with the flutes of the corrugated boards 3 oriented in a direction P across the thickness thereof in a manner similar to the tubular member 11, and an undersized engagement block 13*b* in the form of a laminate of two corrugated cardboards 3A and 3B and bonded to an inner surface of the heptagonal body 13*a*. The undersized engagement block 13*b* is of a structure in which the flutes of each of the corrugated cardboards 3A and 3B are oriented in a direction P parallel to the major surface of the respective engagement block 13*b*, which major surface being perpendicular to a direction across the thickness thereof, while the flutes of one of the corrugated cardboards 3A and the flutes of the other of the corrugated cardboards 3B are oriented at right angles relative to each other.

Figure 8:
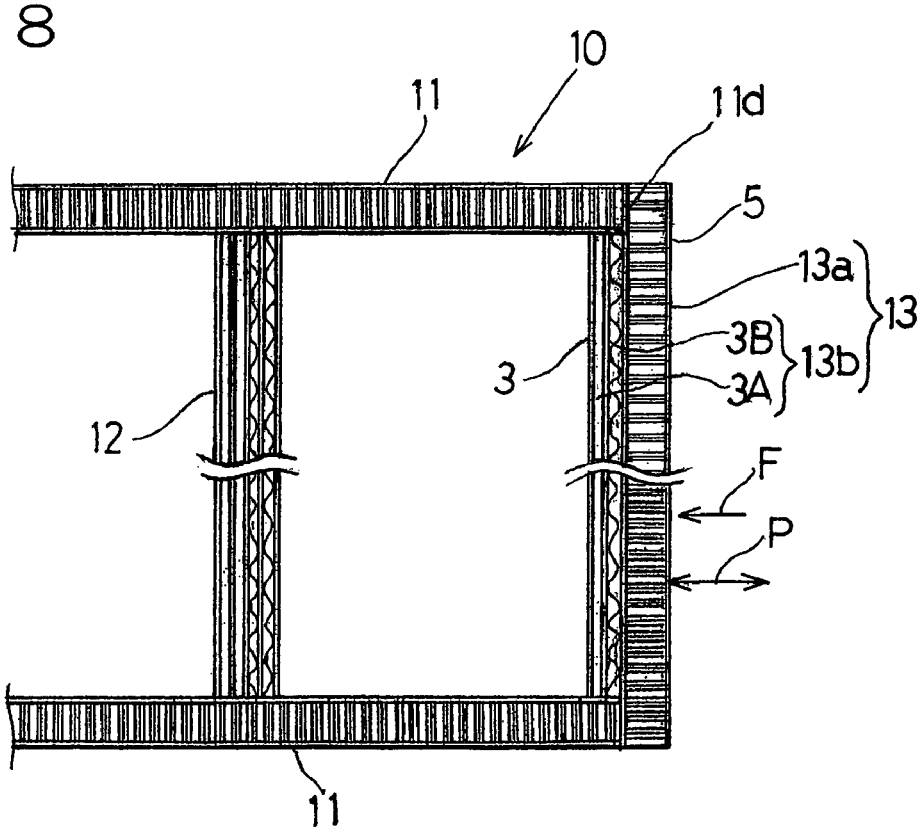
FIG. 8 is a fragmentary longitudinal sectional view showing the elongated tubular members of the formwork in which one of an end wall is held in position.

As shown in FIG. 8, the end wall 13 is bonded to the corresponding open end face 11*d* of the tubular member 11 with the undersized engagement block 13*b* snugly received within the hollow 11*b* of the tubular member 11 to thereby close the open end of the tubular member 11 and also to reinforce the open end thereof.

In the end wall 13 of the structure described above, since the corrugated cardboard plate 5 forming the body 13*a* of the end wall 13 can have a high compressive strength since the flutes in the corrugated cardboard plate 5 forming the body 13*a* are oriented in a direction P aligned with the direction in which the compressive force F acts on the end wall 13 during the casting of the concrete material. Also, at each of the opposite open ends of the tubular member 11, the corrugated cardboards 3A and 3B forming the undersized engagement block 13*b* of the end wall 13 resists against the compressive force acting on respective sides 31-34 of the tubular body 11 to thereby reinforce the tubular body 11 in a direction generally radially outwardly.

Figure 9:
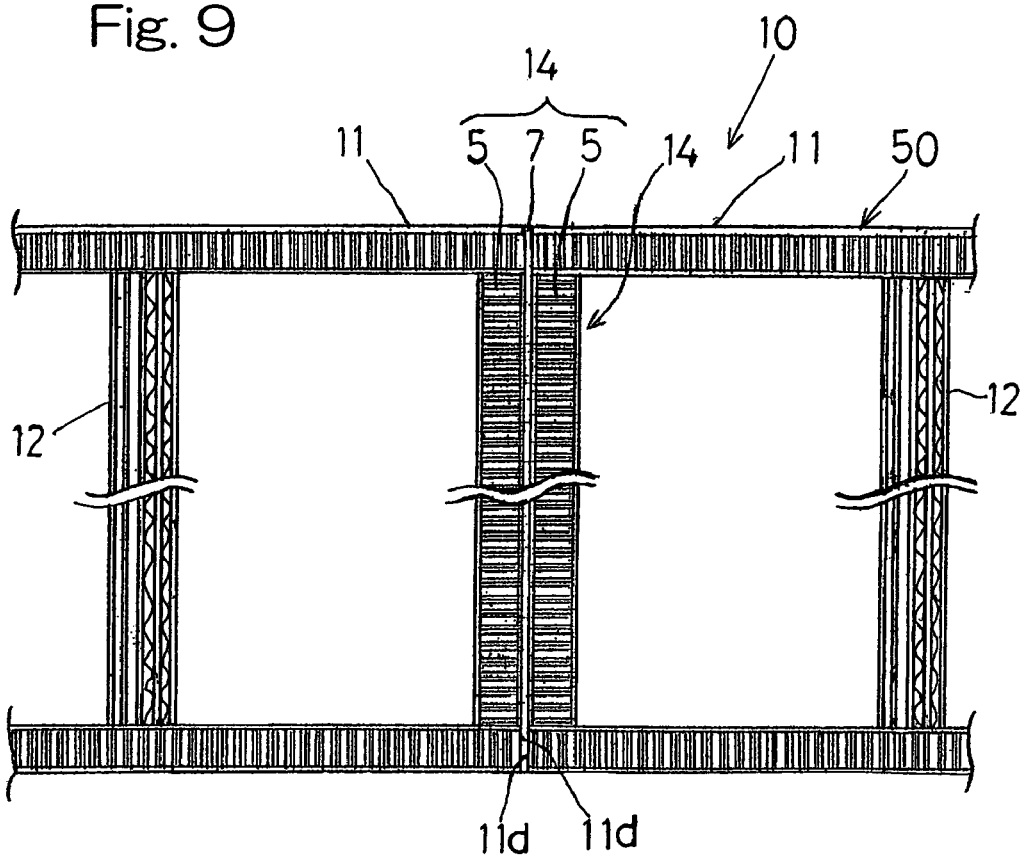
FIG. 9 is a fragmentary longitudinal sectional view showing the manner in which two tubular members of the respective formworks are joined together.

FIG. 9 illustrates an example of use of a plurality of the tubular members 11 connected end-to-end in a direction lengthwise of the roadway. The elongated form 10 forms a tubular row 50 of about 7 to 8 meters in length by connecting a plurality of the tubular members 11, each being, for example, about 2 meters in length. In such case, connection between the neighboring tubular members 11 is accomplished by the use of a connecting wall member 14 of a structure which will now be described.

Figure 10:
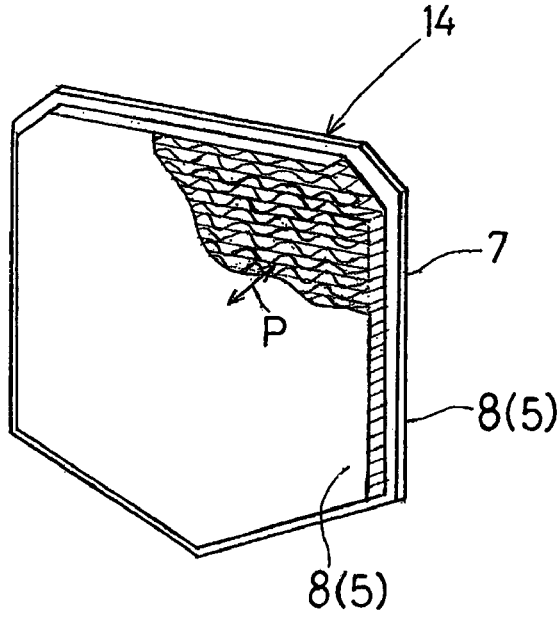
FIG. 10 is a perspective view, with a portion removed away, showing a connecting wall used to connect the tubular members together.

The connecting wall member 14 includes a generally heptagonal base board 7 made up of a t least one paper liner having its opposite surfaces to which respective undersized engagement blocks 8 each prepared from the corrugated cardboard plate 5 are bonded. As shown in FIG. 10, the corrugated cardboard plate 5 for each undersized engagement block 8 has flutes oriented in a direction P across the thickness thereof. To connect the neighboring tubular members 11 together, the undersized engagement blocks 8 of the connecting wall member 14 are snugly received within the respective open ends of the neighboring tubular members 11 with an outer peripheral portion of the base board 7 sandwiched and bonded between the respective end faces 11*d* of the neighboring tubular members 11 as best shown in FIG. 9. Since the corrugated cardboard plate 5 having a high bending strength is used as material for the engagement block 8 and attached to the paper liner 7, the connecting wall member 14 can have an increased strength. It is, however, to be noted that in place of the corrugated cardboard plate 5, the same corrugated cardboard 3A or 3B as used for each of the partition walls 12 shown in FIG. 6 may be employed as material for the engagement block. The tubular row 50 made up of the series-connected tubular members 11 has its opposite open ends each closed by the end wall 13 of the structure shown in and described with reference to FIG. 7.

Figure 11:
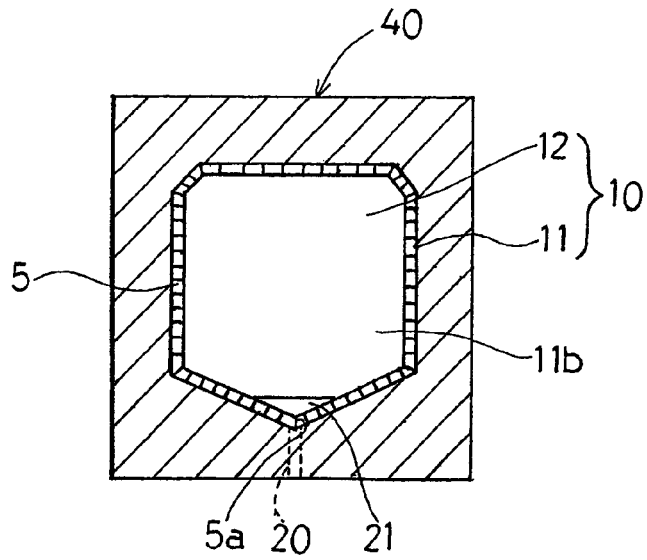
FIG. 11 is a transverse sectional view showing an elongated concrete member having the formwork embedded therein.
Figure 14:
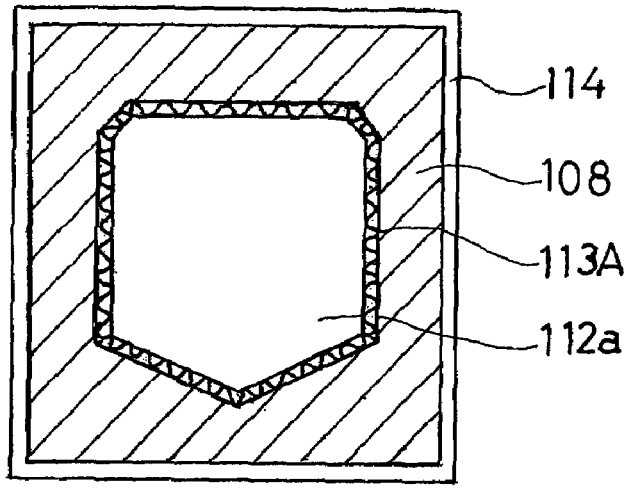
Fig. 14 PRIOR ART
FIG. 14 is a transverse sectional view showing the manner in which concrete is cast in an outer mold to form the concrete beam.
Figure 15:
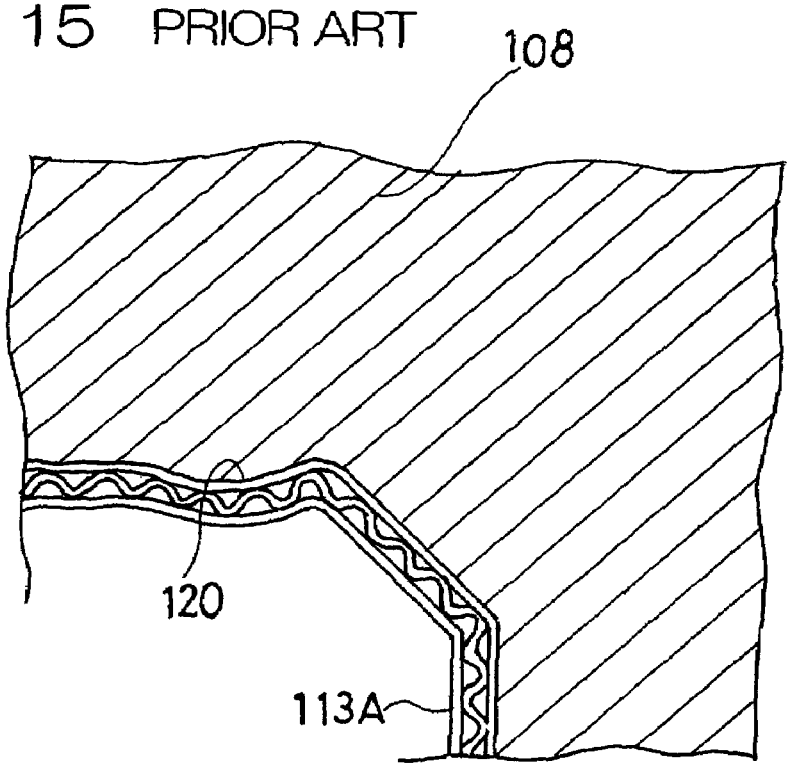
Fig. 15 PRIOR ART
FIG. 15 is a transverse sectional view of a portion of the concrete beam of FIG. 14, showing a portion of the conventional corrugated cardboard having been deformed.

The formwork 10 so designed and so structured as hereinbefore described is placed inside an outer mold in a manner similar to that hitherto practiced as shown in FIG. 14, and the elongated concrete member 40, shown in FIG. 11, having the formwork 10 embedded therein is formed by casting a ready-mix concrete material into the outer mold.

The elongated concrete member 40 may be often formed with one or more drain ports 20 in a bottom portion of the elongated concrete member 40 for drainage of water. This is because when the elongated concrete member 40 has been used in the field for a prolonged period of time, the corrugated cardboards forming the formwork 10 inside the elongated concrete member 40 may be decayed and water may soak in through cracks appearing in the concrete member 40, eventually pooling within the hollow 11*b* of the elongated concrete member 20. In this respect, if a connecting passage 21 for communicating between the neighboring cells separated from each other by the partition wall 12 from each other is formed in a lower portion of the partition wall 12 used in the formwork 10, water pooling inside the hollow 11*b* can be drained to the outside through the drain port 20 by way of a gap 30 between the abutted end edges 5*a* of the corrugated cardboard plate 5 forming the tubular member 11, thereby accomplishing drainage of the water from the elongated concrete member 40.

As hereinbefore fully described, the tubular member 11, the partition walls 12, the end walls 13 and the connecting wall member 14, all forming respective parts of the formwork 10, have an excellent strength and, also, since all of them are prepared from a paper material, the formwork that is lightweight, environmentally friendly and inexpensive can be obtained.

Although the present invention has been fully described in connection with the preferred embodiments thereof with reference to the accompanying drawings which are used only for the purpose of illustration, those skilled in the art will readily conceive numerous changes and modifications within the framework of obviousness upon the reading of the specification herein presented of the present invention. By way of example, although the partition walls 12, the end walls 13 and the connecting wall member 14 have been shown and described as prepared from corrugated cardboards, they may be made of a wood material. Also, where the elongated formwork 10 is used in the elongated concrete member which is not stipulated according to JIS-A-5373, the elongated formwork 10 may have any suitable polygonal section other than the heptagonal section.

Accordingly, such changes and modifications are, unless they depart from the scope of the present invention as delivered from the claims annexed hereto, to be construed as included therein.

What is claimed is:

1. A formwork for use in an elongated concrete member, which is embedded within a hollow of the elongated concrete member during casting of a concrete material, which form comprises:

a tubular member having a polygonal sectional shape formed by bending a corrugated cardboard plate made of paper, wherein the corrugated cardboard plate including a plurality of corrugated cardboards laminated together, each of the corrugated cardboards including a liner sheet bonded to surfaces of a corrugated sheet, the corrugated cardboards being laminated together with flutes of the corrugated cardboards oriented in a direction across a thickness of the corrugated cardboard plate, and a sheet bonded to front and rear major surfaces thereof;

a partition wall made of a corrugated cardboard and positioned inside the tubular member for dividing a hollow of the tubular member into cells; and a connecting passage, formed in a lower portion of the partition wall, for communicating between the neighboring cells separated from each other by the partition wall, the connecting passage being adapted for draining water pooling in the hollow through a drain port in the elongated concrete member.

2. The formwork as claimed in claim 1, wherein portions of the corrugated cardboard plate, which are bent to form the tubular member, are formed with respective cutouts, each of the cutouts having a generally V-shaped section before the corrugated cardboard plate is bent to provide the tubular member.

3. The formwork as claimed in claim 1, wherein each of the partition walls is made up of a plurality of corrugated cardboards bonded together with flutes thereof oriented in a direction parallel to a major surface of the respective partition wall, each of the corrugated cardboards including a liner sheet bonded to surfaces of a corrugated sheet; and wherein at least one of the corrugated cardboards forming the respective partition wall has the flutes oriented in a direction perpendicular to an adjacent corrugated cardboard.

4. The formwork as claimed in claim 1, which comprises a plurality of tubular members, each being of a structure defined in claim 1, which are connected end-to-end with each other through a connecting wall member;

wherein the connecting wall member includes a base board, which includes a paper liner having opposite surfaces to which respective undersized engagement blocks each prepared from a corrugated cardboard plate are bonded, the undersized engagement blocks being, when the tubular members are connected with each other, received within respective open ends of those tubular members.

5. The formwork as claimed in claim 1, further comprising an end wall member made of cardboard for closing each of opposite open ends of the tubular member or a row of tubular members having a plurality of the tubular members connected end-to-end with each other, wherein the end wall member includes a body comprised of the corrugated cardboard plate, with the flutes of the corrugated cardboards forming the corrugated cardboard plate being oriented in a direction across a thickness of the body.

6. The formwork as claimed in claim 1, further comprising an end wall member made of cardboard for closing each of opposite open ends of the tubular member or a row of tubular members having a plurality of the tubular members connected end-to-end with each other, wherein the tubular member and the end wall member have their respective outer surfaces treated with a waterproofing treatment.

* * * * *